US009764349B2

(12) United States Patent
Vecchiet et al.

(10) Patent No.: US 9,764,349 B2
(45) Date of Patent: Sep. 19, 2017

(54) DEVICE FOR GENERATING A GAS JET IN PROCESSES FOR COATING METAL STRIPS

(75) Inventors: Fabio Vecchiet, Cervignano del Friuli (IT); Alessandro Cona, Udine (IT); Gianluca Caporal, Pordenone (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 377 days.

(21) Appl. No.: 14/128,431

(22) PCT Filed: Jun. 21, 2012

(86) PCT No.: PCT/IB2012/053134

§ 371 (c)(1), (2), (4) Date: Dec. 20, 2013

(87) PCT Pub. No.: WO2012/176144

PCT Pub. Date: Dec. 27, 2012

(65) Prior Publication Data

US 2014/0209017 A1 Jul. 31, 2014

(30) Foreign Application Priority Data

Jun. 21, 2011 (IT) ..... MI2011A1131

(51) Int. Cl.
*B05C 11/06* (2006.01)
*C23C 2/20* (2006.01)

(52) U.S. Cl.
CPC ..... *B05C 11/06* (2013.01); *C23C 2/20* (2013.01)

(58) Field of Classification Search
CPC ..... B05C 11/06; C23C 2/20
See application file for complete search history.

(56) References Cited

U.S. PATENT DOCUMENTS 4,041,895 A * 8/1977 Overton ..... B05C 11/06 118/419
2010/0224120 A1 9/2010 Fujioka et al.

FOREIGN PATENT DOCUMENTS

DE 19954231 12/2000
JP H09217162 8/1997

* cited by examiner

*Primary Examiner* — Dah-Wei D Yuan
*Assistant Examiner* — Stephen Kitt
(74) *Attorney, Agent, or Firm* — Stetina Brunda Garred & Brucker

(57) ABSTRACT

The device has a gas flow levelling pipe (3), which defines a continuous curved development surface (Z), at comprising a collector (4) to which a nozzle (10) is fixed, a delivery manifold (1), in order to introduce pressurized gas into the pre-chamber (2) through the holes (12), a first holed partition (5) and a second holed partition (6) within the levelling pipe (3), arranged perpendicular to the curved development surface (Z) of the pipe (3).

18 Claims, 2 Drawing Sheets

DEVICE FOR GENERATING A GAS JET IN PROCESSES FOR COATING METAL STRIPS

FIELD OF THE INVENTION

The present invention refers to a device for generating a gas flow in hot coating processes for metal strips. Such a device is also generally known as an air knife.

STATE OF THE ART

As known, the hot galvanizing process consists in coating zinc on steel strips, by immersing them into a bath of molten zinc (at 450° C.-470° C.) contained in a tank, on both faces and with variable coating thicknesses as a function of the final application. The process is of the continuous type; the steel strip is normalized and the two opposite surfaces are suitably prepared in order to obtain a perfect adhesion of the zinc to the basic steel and the formation of very thin, uniform zinc layer.

The adjustment of the zinc coating thickness is obtained by means of an air knife system, which also allows the coating to be uniformly distributed on the two surfaces and over the whole length of the strip. The system of air knives essentially consists of two lips, defining a nozzle having a predominant dimension as compared to the others and adapted to generate a flat jet, which convey an air jet onto the whole width of the strip and onto each side thereof when the strip emerges from the zinc tank.

The same procedure is employed to generally coat metal strips, irrespective of the nature of the liquid material sticking to the strip being coated. Besides being a zinc alloy, indeed, the liquid can be an aluminium alloy or a paint.

An adjustment system allows the two lips to be inclined and spaced from each other, so as to determine the coating thickness required, which can even be differentiated for each side.

A closed-loop control system, based on a system for measuring the thickness of the zinc coating obtained, allows the quantity of zinc and thus the coating thickness to be optimized.

Standards set the minimum value of the mass/surface ratio ($g/m^2$) of the total zinc coating on both faces, or the minimum coating thickness (microns) on a face, according to the final application of the steel strip.

This is explained by the corrosion resistance of the material over time being directly proportional to the zinc thickness applied to the metal strip.

The quality of the jet produced by the air knife thus represents one of the fundamental factors of the hot galvanizing process.

It is desirable that the air flow is uniformly distributed over space and time on both faces of the strip, so as to guarantee a minimum deviation of the coating thickness with respect to the nominal value.

The air knife extends over the entire width of the strip and is to be provided so as to limit the turbulence therein, before it passes through the nozzle, in order to obtain the aforementioned uniformity of air distribution over space and time.

In order to even the pressure distribution and minimize the vorticity of the air flow, load losses can be considerably increased within the device, but this is a major limit. Therefore, attempts have been made to identify solutions which, despite modest load losses, would still manage to ensure a sufficient uniformity of the air flow.

An air knife is a device comprising a cylindrical pipe, also known as a delivery manifold, injecting air into a sort of annular chamber. Outlet holes for the air under pressure are provided on the lateral surface of the cylindrical pipe, which are aligned over the whole length of the cylinder. One or more holed partitions may be arranged in order to even the air flow within the annular chamber. The cylindrical pipe is generally fed from both ends through a plenum.

Feeding uniformity must be obtained a priori by the body of the air knife, as the nozzle is only able to recover a fraction of possible non-uniformities of the gas pressure.

In the publication DE19954231, for example, a first variant shows a cylindrical pipe having an alignment of holes arranged parallel to the symmetry axis of the pipe. In another variant, the cylindrical pipe has grooves which are parallel to one another and arranged according to meridians of the cylindrical pipe. A third variant shows the cylindrical pipe having alignments of holes which are parallel to each other and arranged according to meridians of the cylindrical pipe. A first holed partition is arranged vertically, i.e. perpendicular to the development axis of the cross-section of the annular chamber. A second and immediately successive partition, following the clockwise motion of the gas, is almost horizontal with holes which open almost perpendicularly to a development plane of the outlet pipe which is substantially tangent to the annular chamber and culminant with the flat nozzle.

In the device described in DE19954231 it is clear that

- the rectilinear stretch which leads to the nozzle is adjacent to the annular chamber, defining a discontinuity in a medial development plane of the total pipe formed by the annular chamber and the rectilinear final stretch,
- the last partition is almost parallel with the development of the rectilinear stretch which leads to the nozzle,
- a fraction of the gas, which rotates in a clockwise direction, passes through the vertical partition, while the remaining fraction, which rotates in an anticlockwise direction, passes through the last partition only, this resulting in two parallel chambers contained in the annular container of the device.

The device shown in such a document causes the gas under pressure to strike and bounce off the lower wall of the last rectilinear stretch with a considerable increase in the turbulence within the device. Furthermore, the two gas fractions collide before passing through the last partition, thus generating further turbulence.

SUMMARY OF THE INVENTION

The object of the present invention is to provide a device to level a gas flow along a nozzle adapted to generate a flat jet, suitable in particular for hot coating processes for metal strips and adapted to improve the uniformity of the gas distribution over the length of the nozzle.

The object of the present invention is a device for generating a flat, laminar gas jet, in particular in hot coating processes for metal strips, comprising in accordance with claim 1,

- a longitudinal delivery manifold having a peripheral wall, the peripheral wall being provided with first holes,
- a levelling pre-chamber communicating with said longitudinal delivery manifold through said first holes,
- a levelling pipe communicating at a first end thereof with said levelling pre-chamber,
- a nozzle adapted to generate the flat gas jet,
- said levelling pipe communicating at a second end thereof with said nozzle, said second end being opposite to and having a smaller section than the first end, so as to be tapered and to create a gas flow path from said levelling pre-chamber to the nozzle, said path defining a curved medial development surface, at least two holed partitions arranged in said levelling pipe perpendicular to said curved medial development surface, thereby defining at least two successive portions of the levelling pipe, which are adjacent and connected to each other, wherein the first holes are provided only in a first longitudinal sector of the peripheral wall of the delivery manifold and said levelling pre-chamber extends outwards at least about said first longitudinal sector, wherein a first portion of the levelling pipe extends outwards about a second longitudinal sector of the peripheral wall of the delivery manifold, adjacent to the first longitudinal sector, and wherein a second portion of the levelling pipe is arranged in a substantially tangential direction with respect to the delivery manifold, downstream of said second longitudinal sector, whereby said curved medial development surface is represented by an ideal continuous curved surface without any angular points, so as to optimize the transformation of the gas flow from turbulent flow at the first end to laminar flow at the second end of the levelling pipe.

In a preferred variant, the levelling pre-chamber is advantageously externally wound about said first longitudinal sector and the first portion of the levelling pipe is externally wound about said second longitudinal sector.

The first portion of the levelling pipe is preferably wound about said second sector or longitudinal portion of the delivery manifold over an angular extent in the range from 30° to 180°, e.g. approximately 90°.

In a preferred variant, the levelling pre-chamber is wound only about said first longitudinal sector, preferably but not necessarily having an angular extent of about 90°.

The device is configured so that the gas flow exiting the delivery manifold, through the first holes, can cross the levelling pre-chamber in a single rotation direction in order to reach the levelling pipe.

A first stretch of the curved medial development surface is substantially at least one portion of a lateral surface of a semi-cylinder, whereas a second stretch of said curved medial development surface, adjacent to said first stretch, is substantially a flat surface.

The present invention advantageously solves the problem of supplying a flow to the nozzle, which flow is uniform over the whole nozzle extension and is especially uniform over time, i.e. free from instability. In particular, the development surface of the levelling pipe being continuous and without any angular points, implies that the first derivative calculated on the development surface of the pipe at any point of the pipe in the direction of the gas flow is also continuous. Thereby, there are no areas in which the flow strikes against the walls of the pipe at angles such as to trigger turbulence. Furthermore, this allows the inserting of levelling partitions with surfaces perpendicular to the gas flow and therefore to the development surface of the levelling pipe, and hole axes which are parallel to the direction of the gas flow, as per the position in which said partitions are arranged.

Between one holed partition and the next, a portion of compressed gas flow levelling pipe is thus defined. Therefore, stretches of levelling pipe are arranged in sequence or in cascade, one respect to the other, downstream of a pre-chamber, thus providing a progressive homogenization of the gas flow.

The levelling pipe, comprising said progressive stretches of levelling pipe, has sections which are orthogonal to the gas flow having a progressively decreasing area towards the nozzle, so that also the portion of the levelling pipe wound on a portion of the delivery manifold does not induce turbulence. In addition, the first and second portions of the levelling pipe are connected so that the flow is introduced into the second portion parallel to the corresponding medial development surface of the second portion.

Furthermore, the partition holes through which the fluid is forced to pass are progressively decreased in diameter while increasing in number according to the position of the respective partition along the development of the direction of the gas flow, thus causing the fluid threads to be arranged parallel to the walls of the pipe, gradually turning the gas flow motion from turbulent to linear. A further advantage is that a partition is arranged in a practically rectilinear portion of the levelling pipe where, inter alia, the turbulence rate is already sensibly decreased, thus resulting in a further, definitive reduction of the turbulence and approaching a linearity which is almost aerodynamically ideal.

The dependent claims describe preferred embodiments of the invention, forming an integral part of the present description.

BRIEF DESCRIPTION OF THE FIGURES

Further features and advantages of the invention will become clearer in light of the detailed description of preferred but not exclusive embodiments of a device to level a gas flow along a nozzle adapted to generate a flat jet, in particular for hot coating processes for metal strips, for example with zinc alloys or aluminium alloys, shown by way of non-limiting example with the aid of the accompanying drawings in which.

The same reference numbers and letters in the figures identify the same elements or components.

DETAILED DESCRIPTION OF PREFERRED EMBODIMENTS OF THE INVENTION

Figure 1:
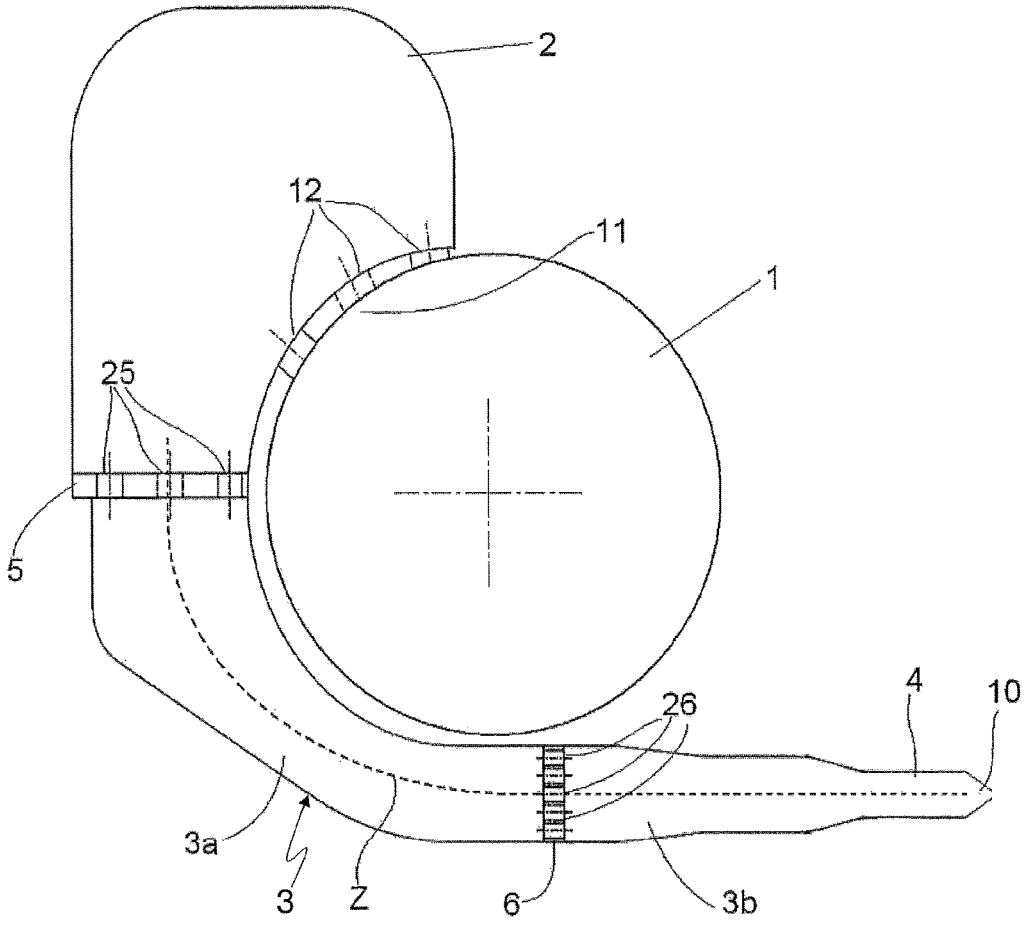
FIG. 1 represents a diagrammatic cross-section view of the device.
Figure 2A:
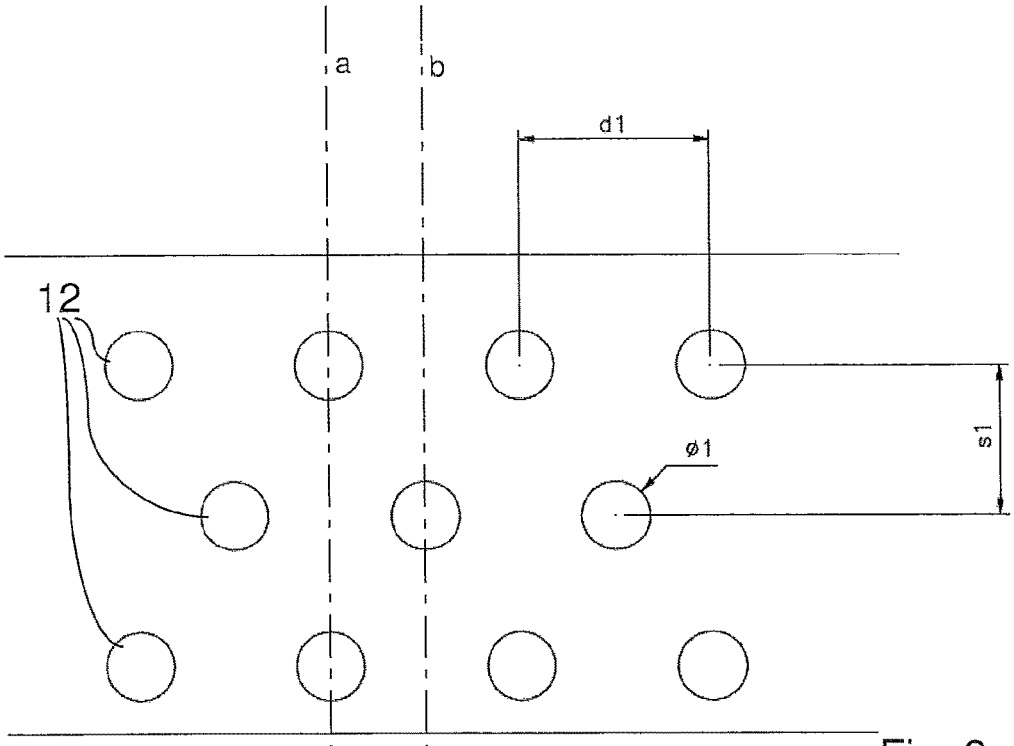
FIGS. 2*a*, 2*b* and 2*c* represent three sections of the device in FIG. 1, orthogonal to the direction of the gas flow.

With reference to FIG. 1, a device to level a gas flow according to the present invention comprises a longitudinal delivery manifold 1 and a levelling pre-chamber 2 which directs the gas from delivery manifold 1 to levelling pipe 3, on which nozzle 10 is engaged. The peripheral wall of the delivery manifold, in a first longitudinal sector 11 of an angular extent of about 90°, over the whole length or longitudinal extension of said manifold, comprises first holes 12 for the gas to pass. In FIGS. 1 and 2*a*, for example, three rows of first holes 12 are provided. In other variants, the number of rows of first holes 12 may be different from three. Levelling pre-chamber 2 overlies the first longitudinal sector 11 in which holes 12 open, and is connected to a levelling pipe 3 divided into a first stretch or portion 3*a* which is wound on the delivery manifold 1 over about a second longitudinal sector, i.e. for about preferably 90°, and into a second stretch or portion 3*b* which substantially extends in the tangential direction with respect to the delivery manifold 1. The two portions of levelling pipe 3 are adjacent and perfectly connected to each other, so as to avoid the presence of edges along the whole levelling pipe.

The longitudinal delivery manifold 1 may have a cross-section which is circular or elliptical or the like, and the lateral surface thereof may be divided into longitudinal sectors of equal or different angular extent. The first portion 3*a* of levelling pipe 3 may extend around a portion or longitudinal sector of the delivery manifold 1, preferably at an angle in the range from 30° to 180°.

Reference letter Z indicates the outline of an ideal medial development surface of the levelling pipe 3 which corresponds to a development axis according to the cross-section of the device shown in FIG. 1 and to the direction of the gas flow in the pipe stretches where it is substantially or completely linear.

Levelling pipe 3 is tapered from the first portion 3*a* towards the second portion 3*b* up to outlet pipe 4, on which nozzle 10 is engaged.

Nozzle 10 may be a separate component or integrally made in one piece with outlet pipe 4. The nozzle 10 shown in FIG. 1 is merely intended to schematize the presence of a nozzle having a width such as to generate a flat gas jet.

The holes 12 allow gas to be introduced into the levelling pre-chamber 2. The stretch of the lateral wall of delivery pipe 1 on which the first holes 12 open may be in common between the delivery pipe 1 and the levelling pre-chamber 2.

A partition 5 is substantially arranged at the joining point between the levelling pre-chamber 2 and the first portion 3*a* of levelling pipe 3. This partition 5 comprises second through holes 25.

A successive partition 6 is substantially arranged in an intermediate area of the second portion 3*b* of levelling pipe 3 downstream of the first partition 5 with respect to the gas flow direction. This partition 6 comprises third through holes 26. It is preferred that partitions 5 and 6 are detachable, for both reasons of maintenance and for modifying the configuration of the device.

Partitions 5 and 6 are perpendicular to the curved medial development surface Z. Said surface Z follows a pattern which is firstly substantially semi-cylindrical and then substantially flat, i.e. a first stretch of the curved medial development surface Z is substantially at least one portion of lateral surface of a semi-cylinder whereas a second stretch of said curved surface Z is substantially a flat surface.

Given the shape of the pipe 3, with particular reference to the device variant in FIG. 1, partition 5 is substantially horizontal and partition 6 is substantially vertical. More generally, the two partitions 5, 6 are arranged on planes which are substantially orthogonal to each other, respectively.

According to the present invention, the perfect connection between the first portion 3*a* and the second portion 3*b* of levelling pipe 3, which has each wall rounded, facilitates instead an outflow of gas without triggering turbulent phenomena.

Furthermore, holed partitions 5 and 6 are always perpendicular to surface Z with the axis of the respective holes parallel to the direction of laminar motion of the gas flow in the respective positions along levelling pipe 3.

There is a relationship between the turbulence intensity and the position of the holed partitions 5 and 6, with particular reference to the partition 6: it has been verified that if the fluid reaches the holed partition 6 with a high turbulence rate, the levelling action of the holes 26 is not exploited to full advantage. It is preferred that partition 6 is spaced apart from previous partition 5, whereby the turbulence rate at the inlet of partition 6 is at least 7% lower than the total gas flow, the remaining amount of flow moving with laminar motion.

Therefore, partition 6 working with a turbulence rate lower than 7% and preferably lower than 5% is particularly important.

The narrowing of levelling pipe 3 essentially takes place between partition 5 and outlet pipe 4, ending with nozzle 10; in the case of a device having a nozzle characterized by a predominant dimension with respect to the others, i.e. with a width of about 2-3 meters and a much lower height and length than the width, in order to generate a corresponding planar gas jet with a width of 2-3 meters, there is a reduction in the section to ¼, e.g. changing from a section of 60 mm to one of 15 mm. This is provided for an overall path measured on the ideal surface Z between 500 and 900 mm.

According to another aspect of the invention, first holes 12, second holes 25 and third holes 26 are dimensioned and arranged so as to have a particular relationship to each other.

First 12, second 25 and third holes 26 are preferably circular holes.

Figure 2B:
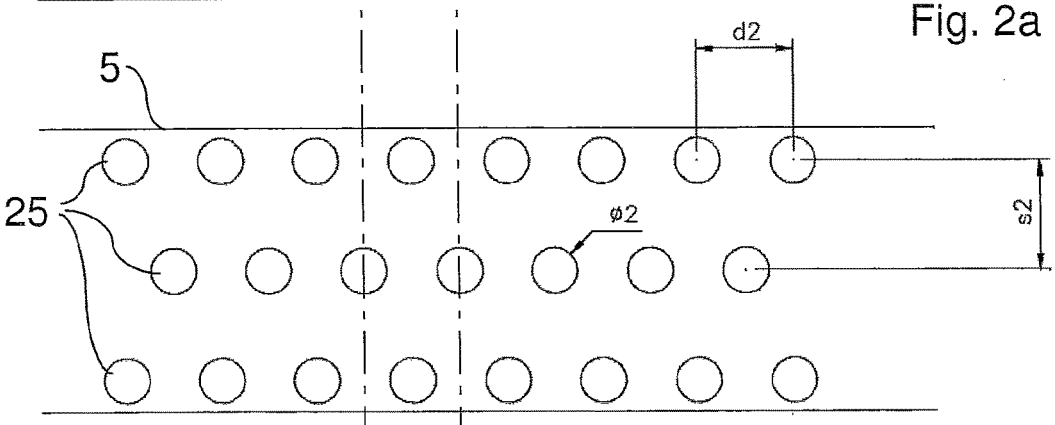
Figure 2C:
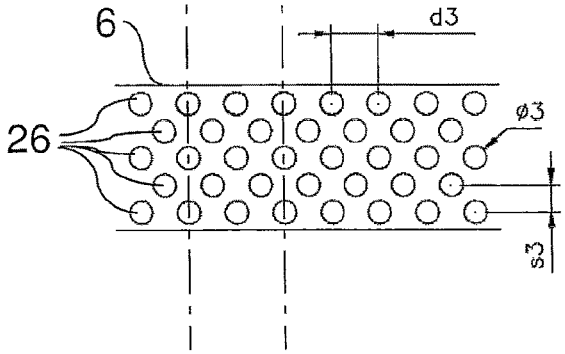

With reference to FIGS. 2*a*, 2*b* and 2*c*:

- the first holes 12 have a diameter Φ1 and are spaced from one another in a first direction by a measure equal to d1 and in a second direction, perpendicular to the first direction, by a measure equal to s1;
- the second holes 25 have a diameter Φ2 and are spaced from one another in a first direction by a measure equal to d2 and in a second direction, perpendicular to the first direction, by a measure equal to s2;
- the third holes 26 have a diameter Φ3 and are spaced from one another in a first direction by a measure equal to d3 and in a second direction, perpendicular to the first direction, by a measure equal to s3;

The relationship between diameters Φ1 and Φ2 and between diameters Φ2 and Φ3 is advantageously equal to the rate of increase of the hole number. The distances s2, d2 and s3, d3 between the holes decrease accordingly, along the gas flow path. For example, if the diameter of the second holes 25, which are on the partition 5, is halved with respect to the diameter of the first holes 12, the number of the second holes 25 is doubled with respect to the number of first holes 12. This occurs independently from the portion of levelling pipe 3 in which the holes are arranged. This entails that the three series of holes, as is the case of the variant in FIG. 1, express the same load loss. Therefore, an overall load loss is equal to three times the load loss on one of the three series of holes.

For all the series of holes, the holes of two successive rows are reciprocally offset so as to define a number of columns which is double with respect to the case in which the holes are aligned. Furthermore, successive columns are equally spaced from one another. The same rule for dimensioning and positioning the holes also applies when there is more than two partitions, e.g. three or four.

FIGS. 2*a*, 2*b* and 2*c* show, from top to bottom, the first series of holes 12 (FIG. 2*a*), partition 5 (FIG. 2*b*) and partition 6 (FIG. 2*c*). It is worth noting that the two parallel and vertical lines a and b pass through the centres of the holes 12 of two successive columns.

Said lines a and b pass through the centres of holes 25 and through the centres of further holes 26 on partitions 5 and 6, respectively.

Between lines a and b there is an intermediate row of holes 25, i.e. which is not crossed by the lines.

Between lines a and b there are three intermediate rows of holes 26, i.e. which are not crossed by the lines.

Therefore, it is worth noting that as the number of hole rows increases, the diameter of said holes similarly decreases.

The present invention advantageously solves the problem of supplying a flow to nozzle 10, which flow is uniform over the whole length of the nozzle and stable over time.

This is firstly due to the development surface Z of levelling pipe 3, which does not have any discontinuity; then, due to the fact that the partitions through which the fluid passes are always arranged perpendicularly to development surface Z.

A further optimization of the flow is obtained because the holes, from those of the peripheral wall of the delivery manifold to the holes provided in the last holed partition of the levelling pipe, progressively decrease in diameter while increasing in number.

Furthermore, partition 6 is arranged in portion 3*b*, where the corresponding part of medial development surface is substantially flat: this generates a synergic effect between said portion 3*b* of the levelling pipe 3 and partition 6 arranged therein. Also, especially because said partition 6 has holes of very small diameter which are able to further decrease the turbulence to a rate of less than 2%, thus achieving the production of a gas flow motion which is almost exclusively laminar at outlet pipe 4.

The device of the present invention advantageously has a lower loss load with the uniformity of the gas flow directed to flat nozzle 10 being equal. This results in a greater shear stress of the jet exerted on the strip with greater and better removal of the excess zinc.

The elements and features shown in the various preferred embodiments can be combined, without however departing from the scope of protection of the present application.

The invention claimed is:

1. A device for generating a flat, laminar gas jet, in particular suitable for hot coating processes for metal strips, comprising:

a longitudinal delivery manifold having a peripheral wall, a cross section, and a longitudinal extension, said peripheral wall being provided with first holes, a levelling pre-chamber communicating with said, longitudinal delivery manifold through said first holes, a curved levelling pipe communicating at a first end thereof with said levelling pre-chamber, a nozzle adapted to generate the flat laminar gas jet, said levelling pipe communicating at a second end thereof with said nozzle, said second end being opposite to and having a smaller cross section than the first end, so as to be tapered and to create a gas flow path from said levelling pre-chamber to the nozzle, said gas flow path defining a curve corresponding to the curve of the levelling pipe, at least two holed partitions arranged in said levelling pipe and perpendicular to said curved gas flow path, thereby defining at least two successive, adjacent portions of the levelling pipe which are connected to each other, wherein the first holes are provided in a first area defining a first radial arc of the peripheral wall of the longitudinal delivery manifold, and extending continuously along the whole length of the peripheral wall of the longitudinal delivery manifold, and said levelling pre-chamber extends externally at least about said first area, wherein a first portion of the curved levelling pipe extends externally about a second area of the peripheral wall of the longitudinal delivery manifold, wherein said second area extends continuously along the whole length of the peripheral wall of the longitudinal delivery manifold and defines a second radial arc of the peripheral wall, said second area being adjacent to the first area, and wherein a second portion of the levelling pipe is arranged in a substantially tangential direction with respect to the longitudinal delivery manifold, downstream of said second area, whereby an interior surface of the curved levelling pipe contains no angular points, so as to optimize the transformation of the gas flow from turbulent flow at the first end to laminar flow at the second end of the curved levelling pipe.

2. A device according to claim 1, wherein said levelling pre-chamber is externally wound about said first area, and wherein said first portion of the levelling pipe is externally wound about said second area.

3. A device according to claim 1, wherein said second area is limited to a radial arc of said cross section in the range from 30° to 180.

4. A device according to claim 3, wherein said second area is limited to a radial arc of said cross section equal to approximately 90.

5. A device according to claim 2, wherein said second area is limited to a radial arc of said cross section in the range from 30° to 180°.

6. A device according to claim 5, wherein said second area is limited to a radial arc of said cross section equal to approximately 90°.

7. A device according to claim 1, wherein said levelling pre-chamber only surrounds said first area.

8. A device according to claim 7, wherein said first area has an radial arc of approximately 90°.

9. A device according to claim 1, wherein a first stretch of the curved gas flow path is substantially at least one portion of a lateral surface of a cylinder, whereas a second stretch of said curved medial development surface, adjacent to said first stretch, is substantially a flat surface.

10. A device according to claim 1, wherein said at least two holed partitions comprise a first holed partition and a second holed partition arranged downstream of said first holed partition.

11. A device according to claim 10, wherein said first holed partition is arranged at the joining point between the levelling pre-chamber and the first portion of the levelling pipe.

12. A device according to claim 10, wherein the second holed partition is substantially arranged at the joining point between the first portion and the second portion of the levelling pipe.

13. A device according to claim 11, wherein the second holed partition is substantially arranged at the joining point between the first portion and the second portion of the levelling pipe.

14. A device according to claim 10, wherein the section of said levelling pipe in a stretch between the first holed partition and an outlet pipe decreases to about ¼ of an initial value.

15. A device according to claim 10, wherein said first holed partition comprises second holes and said second holed partition comprises third holes and wherein the diameter of holes on the peripheral wall, on the first holed partition and on the second holed partition decreases along the gas flow path as the number of holes increases.

16. A device according to claim 15, wherein the diameter of said second holes is half of the diameter of said first holes and the number of said second holes is double the number of said first holes.

17. A device according to claim 15, wherein the diameter of said third holes is half of the diameter of said second holes and the number of said third holes is double the number of said second holes.

18. A device according to claim 16, wherein the diameter of said third holes is half of the diameter of said second holes and the number of said third holes is double the number of said second holes.

* * * * *